United States Patent [19]

Farley

[11] Patent Number: 4,601,585

[45] Date of Patent: Jul. 22, 1986

[54] TIME DISPLAY SYSTEM

[76] Inventor: Brent L. Farley, 4215 Connecticut Ave., Baltimore, Md. 21229

[21] Appl. No.: 798,908

[22] Filed: Nov. 18, 1985

[51] Int. Cl.[4] ..... G04B 19/04

[52] U.S. Cl. ..... 368/80; 368/238

[58] Field of Search ..... 368/76, 80, 223, 228, 368/229, 238

[56] References Cited

U.S. PATENT DOCUMENTS 3,184,912 5/1965 Freeburg et al. ..... 368/238

3,952,500 4/1976 Tomura ..... 368/80

FOREIGN PATENT DOCUMENTS 39365 12/1927 Denmark ..... 368/238

*Primary Examiner*—Vit W. Miska

*Attorney, Agent, or Firm*—John F. McClellan, Sr.

[57] ABSTRACT

An illusory time display system of clock hand or hands in a case too small in radial dimension to permit normal rotation of the hands around the case, provides nevertheless for normal rotation of the hands and accurate conventional display of time. The outer ends of the hands travel in a smoothly contoured channel along the case periphery and collapse axially into themselves by contact with the case as they are conventionally rotated by any conventional drive, to accomplish the apparently impossible non-jamming travel around the too-small case. Various versions of odd-shaped and/or non-concentric timepiece face, case, and hands that further the illusion are disclosed.

19 Claims, 12 Drawing Figures

TIME DISPLAY SYSTEM

FIELD OF THE INVENTION

This invention relates generally to analog time displays and particularly to an improved clock or watch.

BACKGROUND OF THE INVENTION

In the prior art, clock faces with hands have been known for centuries, and in various styles. Hands painted on rotating transparent faces have been known and various other novel, puzzling-type time displays as well.

SUMMARY OF THE INVENTION

However, a timepiece hand system of the conventional type with a hand or hands that appears certain to jam for lack of peripheral room to travel in normal rotation in the case, but that continue to travel and indicate time in normal fashion is believed not known, and to provide such is a principal object of this invention.

Further objects are to provide such a system in which more than one hand may exhibit the apparently impossible travel where there is no room as described, to provide such a system in which all, or only a portion of the rotational travel is puzzling, and to provide such a system in which there is considerable choice among means of achieving the desired illusion.

Yet further objects are to provide a system that is attractive in appearance, that can be embodied in a variety of cases, and that requires no modification of the basic, conventional clock drive employed.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
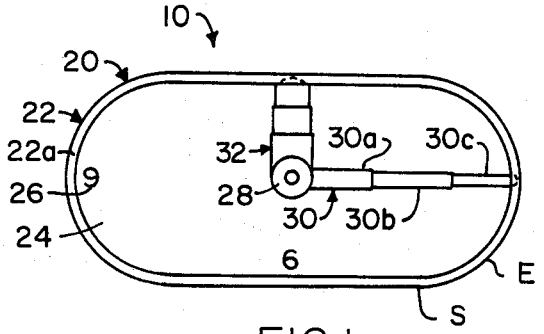
FIG. 1 is a face view of a first embodiment of the invention.
Figure 2:
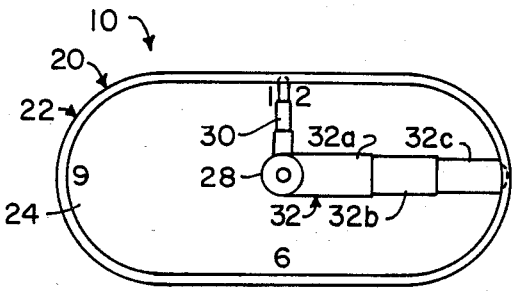
FIG. 2 is a face view thereof with the hands in a different position.

FIGS. 1 and 2 show embodiment 10 of the invention.

The timepiece shown has an elongate case 20 with upstanding recurved rounded ends E and sides S, comprising a frame 22, and contains a face 24 that may have any conventional hour indications 26. A conventional hub assembly 28 symmetrically disposed centrally in the case connects a conventional clock or watch drive, not shown, with the minute hand 30 and the hour hand 32, which is broader than the minute hand for clarity of indication.

The minute hand 30 obviously is too long to rotate 360 degrees around the face 24 in the case 20 at the 12:15 O'Clock depiction and similarly the hour hand 32 is too long to rotate around the case in the 3:00 O'Clock depiction. The hands do rotate around the face however, in normal timepiece fashion, by means of the following provision.

Each hand has longitudinally extensible and collapsible telescoping elements, an extensible plurality of telescoping sleeves, as at 30*a*, 30*b*, 30*c*, and 32*a*, 32*b*, 32*c* respectively, and means associated with the telescoping elements for biasing the hand toward the extended mode, as will be explained later.

As the hands travel around the clock they simply lengthen and shorten as necessary to avoid jamming. Radial contact with the frame 22 applies the necessary radial retraction force to the outer ends of the hands, but the hand-frame contact is concealed by the frame recurve of channel flange 22*a*. The flange 22 is shown narrower than it might be in relation to hand width, for exposition.

Figure 3:
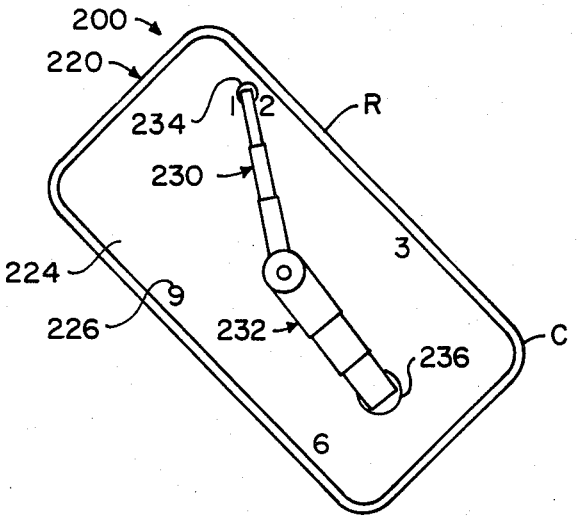
FIG. 3 is a face view of a second embodiment.
Figure 4:
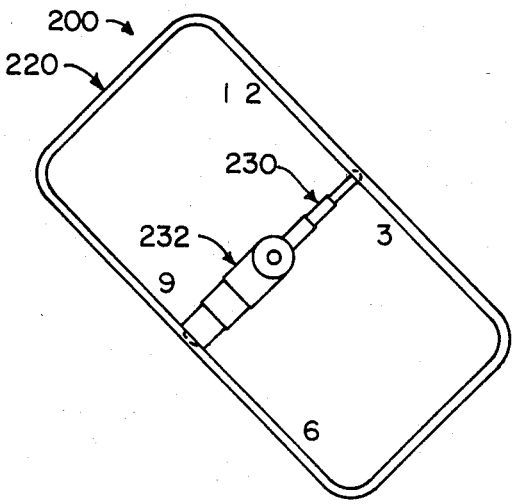
FIG. 4 is a face view thereof with the hands in a different position.

FIGS. 3 and 4 show a second embodiment 200 with case 220 in the shape of a rectangle R with rounded corners C. The hands 230, 232 are similar to those described above except that they may have rollers 234, 236 on the ends for friction reduction, and may be shorter than the length required for riding on the case all-around-the-clock. The hour indications 226 may be assymetrical relative to the face 224 and case 220.

Figure 5:
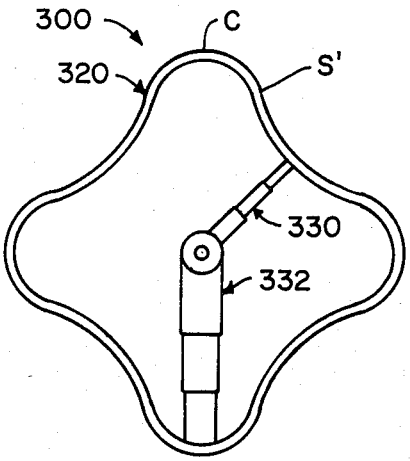
FIG. 5 is a face view of a third embodiment.

FIG. 5 shows a third embodiment 300 with case 320 in the shape of a four-lobe gear with rounded corners C fairing into concavely rounded sides S'. The outer ends of the hands 330, 332 may always be concealed.

Figure 6:
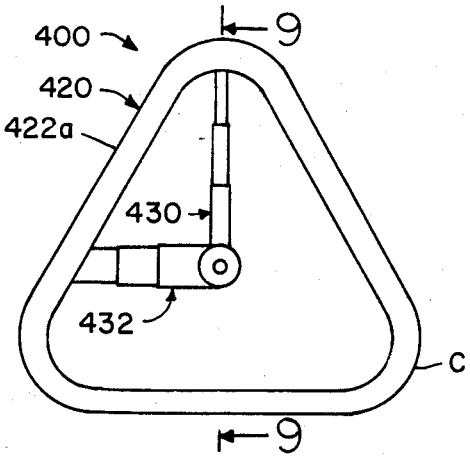
FIG. 6 is a face view of a fourth embodiment.

FIG. 6 shows a fourth embodiment 400 with triangular case 420 having rounded corners C. The outer ends of the hands 430, 432 are concealed behind the frame portion 422*a*, and may have ball bearing ends.

Figure 7:
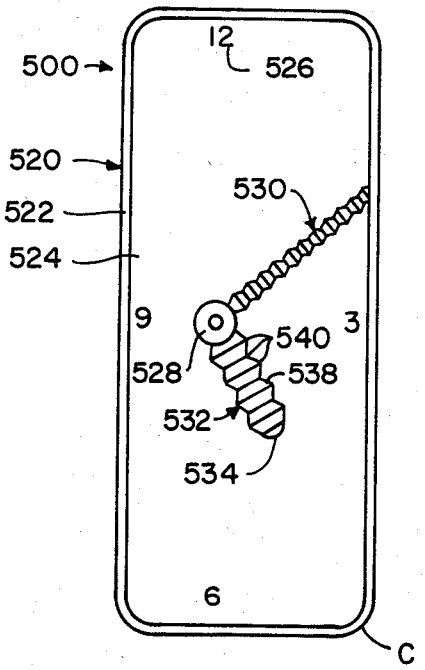
FIG. 7 is a face view of a fifth embodiment.

FIG. 7 shows a fifth embodiment 500 with rectangular case 520 with rounded corners C and with hub 528 offset asymmetrically in it; offset also may be hour indicators 526. The hands 530, 532 may be metal bellows 538 with convolutions 540 that resiliently bias them toward elongation, extending them to a point of concealment and retracting contact with the frame 522 for at least part of the revolution around the clock face 524. The hands preferably have rollers (543 shown) at the outer ends.

Figure 8:
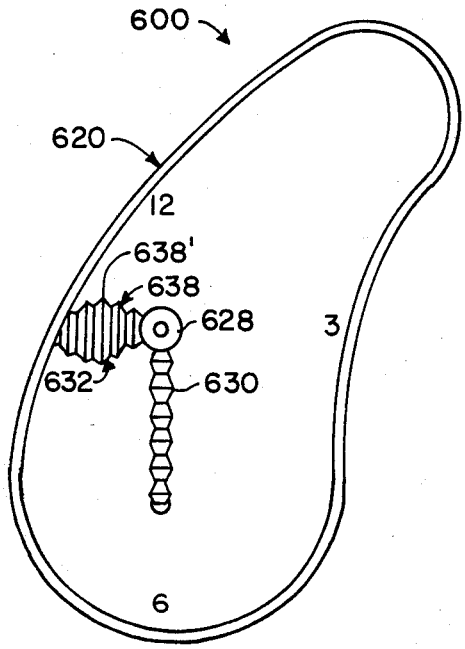
FIG. 8 is a face view of a sixth embodiment.

FIG. 8 shows a sixth embodiment 600 which may have an oyster-shaped case 620 asymmetrical and with the hub 628 off-set to one side. The showings in all the Figures are by way of example and can be mixed. Here exemplified in a further bellows feature, the bellows 638 of the hour hand 632 as an example is expanded in part as at 638' for greater rigidity under lateral load. In other words, the convolutions may be broader across in a first region than in a second region. Attachment of the bellows to the hub may be by cementing or by soldering, depending on whether thermoplastic or metal bellows are used. Minute hand is 630.

Figure 9:
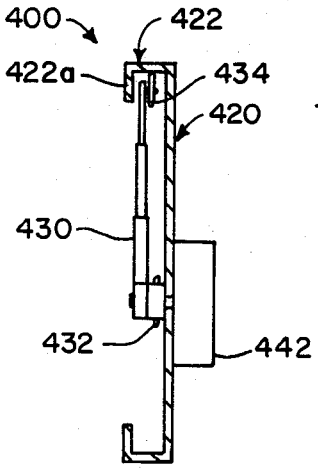
FIG. 9 is an edge view in partial section adapted from 9—9, FIG. 6.

FIG. 9 shows sectional aspects of the fourth embodiment 400 depicted also in FIG. 6. Clock drive motor and gearing are in a conventional housing 442 attached to the back of the case 420.

Frame 442 is recatangular in section and has the returned portion 422*a* concealing the outer ends of the hands 430, 432 that have rollers as at 434.

Figure 10:
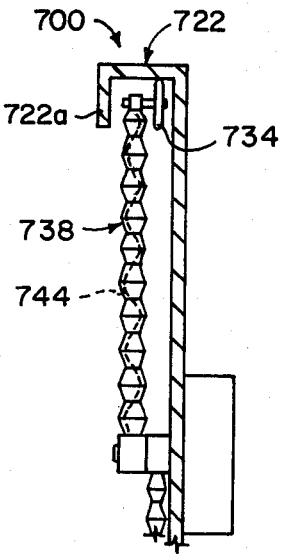
FIG. 10 is a partly sectional diagram of a seventh embodiment, preferred for simplicity.

FIG. 10 shows a seventh, preferred embodiment 700 in which a bellows 738 forming the long hand (for example) has in it a compression spring 744 extending the roller 734 to contact with the frame 722, the contact being concealed by the radially inwardly returned channel flange or frame portion 722*a*.

Figure 11:
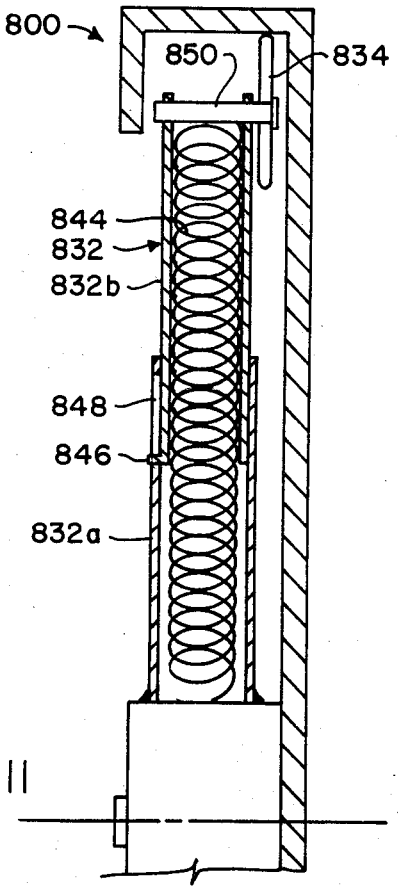
FIG. 11 is a partly sectional diagram on an enlarged scale of an eighth embodiment, similar to that of FIG. 9.

FIG. 11 shows in embodiment 800 an extension spring 844 similar to that of FIG. 10 but extending to the contact with the frame the roller 834 of a telescoping hand 832 having two elements 832*a*, 832*b*.

A tang 846 sliding in a slot 848 may be used to prevent rotation about the long axis of one element 832*a* relative to the next 832*b*, or disassembly.

Figure 12:
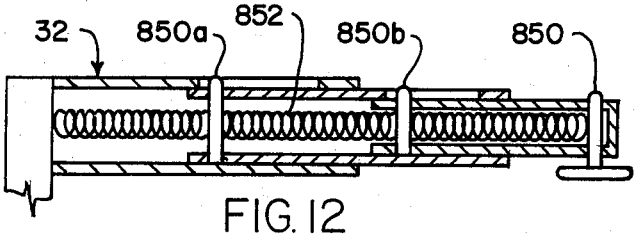
FIG. 12 is a sectional diagram of a hand.

FIG. 12 shows that the three-part telescoping sleeve hands 32 shown, may have a similar spring arrangement except that a single long spring 852 extending from end-to-end of the hand may be screwed in place past transverse rods 850*a*, 850*b* like the roller axle 850, which an intermediate portion of the spring may engage, and against the end of a third sleeve.

As indicated, care is taken to prevent the hand structure from giving away the secret. As with the case shape, other structures that function the same way may be used without departing from the spirit of the invention. For example, the hands may be of the same length, or may be of articulated construction.

This invention is not to be construed as limited to the particular forms disclosed herein, since these are to be regarded as illustrative rather than restrictive. It is, therefore, to be understood that the invention may be practiced within the scope of the claims otherwise than as specifically described. For example, air-extended bellows can be used.

What is claimed and desired to be protected by U.S. Letters Patent is:

1. In a system having: case, face, hand structure including outer-end hand structure, and means for rotating the hand structure around the face for indicating time, the improvement comprising: means for creating the illustion that the case has at least one dimension thereacross that is too small to permit the hand structure to rotate around the face, including means for shortening the hand structure by contact with a portion of the case on said rotating.

2. In a system as recited in claim 1, said portion of the case comprising an outer portion.

3. In a system as recited in claim 2, said outer portion including structure defining a channel proportioned for receiving therein and concealing the outer-end hand structure.

4. In a system as recited in claim 3, provision on the outer-end hand structure for reducing friction of said contact.

5. In a system as recited in claim 4, said provision including means for rolling.

6. In a system as recited in claim 1, said hand structure including an hour hand and a minute hand.

7. In a system as recited in claim 1, said hand structure comprising an extensive plurality of telescoping sleeves.

8. In a system as recited in claim 7, a spring biasing said extensive plurality of telescoping sleeves to extend.

9. In a system as recited in claim 1, said hand structure comprising extensible bellows structure.

10. In a system as recited in claim 9, a spring biasing said extensible bellows structure to extend.

11. In a system as recited in claim 9, said bellows structure comprising resiliently elongatable structure and biased toward elongation.

12. In a system as recited in claim 9, said bellows structure having a first region of convolutions and a second region of convolutions, and the first region of convolutions being broader than the second region of convolutions.

13. In a system as recited in claim 1, said case being elongate.

14. In a system as recited in claim 1, said rotation being about a center of rotation, and said case being symmetrical with respect to said center of rotation.

15. In a system as recited in claim 13, said rotation being about a center of rotation, and said case being asymmetrical with respect to said center of rotation.

16. In a system as recited in claim 1, the case having an outer portion concealing said outer-end hand structure during a portion of said rotation.

17. In a system as recited in claim 1, the case having an outer portion concealing said outer-end hand structure portion during all said rotation.

18. In a system as recited in claim 1, the hand structure comprising an hour hand and a minute hand, and the hour hand being broader than the minute hand.

19. In a system as recited in claim 18, the hour hand and the minute hand being the same length.

* * * * *